US005306391A

United States Patent [19]

Cirucci et al.

[11] Patent Number: 5,306,391

[45] Date of Patent: Apr. 26, 1994

[54] CONTROL OF CHEMICAL DOSAGE TO A PULP SLURRY

[75] Inventors: John F. Cirucci, Allentown; Harold H. Gunardson, New Tripoli, both of Pa.

[73] Assignee: Air Products and Chemicals, Inc., Allentown, Pa.

[21] Appl. No.: 899,415

[22] Filed: Jun. 16, 1992

[51] Int. Cl.[5] ..... D21C 3/00

[52] U.S. Cl. ..... 162/49; 162/61; 162/62; 436/55

[58] Field of Search ..... 162/49, 198, 238, 263, 162/61, 62; 436/55

[56] References Cited

U.S. PATENT DOCUMENTS

| | | | |
|---|---|---|---|
| 3,650,890 | 3/1972 | Kamio | 162/49 |
| 3,745,065 | 7/1973 | Niilo-Rama | 162/49 |
| 4,540,468 | 9/1985 | Genco et al. | 162/49 |
| 4,717,672 | 1/1988 | Fleming et al. | 162/61 |
| 4,946,555 | 8/1990 | Lee et al. | 162/49 |

OTHER PUBLICATIONS

Cirucci, J. F.; "Optimizing Oxygen Extraction By Vent Gas Analysis: Process Control and Safety"; Jul. 1986; Tappi Journal, pp. 94-97

US Appl. Ser. No. 07/797,866; Cirucci, et al.; filed Nov. 26, 1991; "Application of Oxygen and Steam in Pulp Using Ejectus".

*Primary Examiner*—W. Gary Jones
*Assistant Examiner*—Dean T. Nguyen
*Attorney, Agent, or Firm*—John M. Fernbacher; William F. Marsh; James C. Simmons

[57] ABSTRACT

A method is disclosed for controlling a desired chemical dosage to a stream of cellulosic pulp heated by the addition of steam wherein the pulp flow rate is determined indirectly by measuring the pulp temperature after steam addition and calculating the pulp flow rate by heat balance. Changes in pulp flow rate are reflected by changes in pulp temperature at known steam addition rates, and the chemical flow rate is adjusted accordingly to maintain constant chemical dosage. The method is particularly useful in controlling oxygen dosage in oxygen delignification and bleaching processes.

16 Claims, 2 Drawing Sheets

CONTROL OF CHEMICAL DOSAGE TO A PULP SLURRY

FIELD OF THE INVENTION

This invention pertains to bleaching or delignification of cellulosic pulp, and in particular to a method for controlling the dosage of chemicals to the pulp prior to a bleaching or delignification reactor.

BACKGROUND OF THE INVENTION

The dosage of treating chemicals in the bleaching or delignification of cellulosic pulp is difficult to control accurately because the flow rate of pulp in most continuous pulp treating processes varies with time, and the direct measurement of pulp flow rate is difficult because the pulp contains two or three phases (fibers, liquor, and optionally dispersed gas) and often is not completely homogeneous. Known methods of pulp flow measurement are often applied at a location in a pulp treating sequence removed from the location of chemical addition, and because of lag times and pulp inventories a pulp flow rate measured at one location is not representative of the flow rate at another location in the process. Inaccurate dosage of chemicals is undesirable for several reasons. Overdosage wastes treating chemicals and may affect downstream process steps adversely, and also may result in poor pulp properties; underdosage results in incompletely treated pulp; and cyclic underdosing and overdosing yields a nonhomogeneous pulp product.

In oxygen delignification and bleaching processes, the flow of oxygen to the pulp-oxygen mixing device prior to the reactor is generally set in excess of the actual requirement and controlled according to a pulp flow signal and pulp consistency measurement. Pulp properties such as Kappa number, brightness, and viscosity are determined periodically by laboratory analyses, and these results may be used judgmentally to adjust the oxygen dosage. Online Kappa number analyzers are available and have found some use for feedback or feedforward control of oxygen dosage. In the feedback mode, online Kappa number measurement can be used for oxygen flow control independent of pulp flow rate. However, a sampling/analysis time of at least five minutes is required for this type of analyzer, and this lag time can adversely affect control performance. In addition, the Kappa number is measured on treated pulp discharged from a reactor which may have a residence time of up to one hour, which also increases control lag time. When online Kappa number measurement is used in the feedforward mode, pulp flow rate measurement is required, and the difficulties associated with pulp flow rate measurement adversely affect this control mode. Online Kappa number analyzers are expensive and maintenance-intensive.

The measurement of residual oxygen gas in the reactor offgas is an alternative method of determining and controlling oxygen dosage. In this method, the flow rate of the offgas is irregular and difficult to measure; instead, the residual oxygen concentration is measured, and the amount of excess oxygen is determined indirectly by knowing the quantity of air entrained in the pulp or by adding an inert tracer gas such as helium to the oxygen before dosing the pulp. This determination of excess oxygen is then used to adjust the oxygen flow rate to maintain oxygen dosage at the desired level. This method is useful for approximate correction of oxygen dosage at specific time intervals, but is not suited for continuous online control of oxygen dosage because the excess oxygen is determined at the reactor outlet, which introduces a large lag time into the control system as earlier discussed.

None of these previous methods for controlling chemical dosage, particularly oxygen dosage, to cellulosic pulp is completely satisfactory. There is no known online method for determining the amount of oxygen in a pulp immediately after oxygen addition prior to the reactor, which would eliminate the lag time associated with determining excess oxygen in the reactor discharge. In addition, methods for accurate, direct measurement of pulp flow rate do not exist. The method of the present invention, as defined in the following specification and claims, allows the online control of chemical dosage, particularly oxygen dosage, to a pulp without the need for direct pulp flow rate measurement.

SUMMARY OF THE INVENTION

The invention is a method for controlling a desired chemical dosage to a continuous flow of cellulosic pulp heated by the addition of steam wherein the flow rate of the pulp is determined indirectly by measurement of pulp temperature after steam addition. The desired chemical dosage is then readily determined and applied to the pulp. As the pulp flow rate varies, the chemical addition rate is automatically adjusted to maintain the desired dosage. This is accomplished by: a) establishing a functional relationship between the flow rate of the pulp and the temperature of the pulp after mixing with one or more selected flow rates of steam; (b) measuring the temperature of the pulp after addition of steam and measuring the flow rate of the added steam; (c) calculating the flow rate of the pulp by utilizing the relationship of step (a) and the temperature and steam flow rate of step (b); (d) calculating the desired flow rate of chemical such that the desired dosage is achieved, and setting the flow rate of chemical to the desired flow rate; and (e) combining and mixing the steam, chemical, and pulp.

The method is particularly useful for controlling oxygen dosage in oxygen delignification and bleaching processes. The flow rates of oxygen, steam, or oxygen-steam mixtures can be controlled in different embodiments of the invention to achieve the required oxygen and steam dosage. In one embodiment in which the steam rate and pulp inlet temperature are relatively constant, the temperature of the pulp after addition of oxygen and steam is measured, and this variable (which is proportional to pulp flow rate) is used to control the pressure of oxygen supplied to a steam ejector which produces a steam-oxygen mixture for addition to the pulp. In an alternate embodiment, the measured pulp temperature is used to control the flow rate of oxygen prior to mixing with steam. In a related embodiment, the steam-oxygen ratio is controlled in conjunction with control of the oxygen flow rate.

When the pulp feed temperature is not constant, the difference between the feed temperature and the temperature after steam addition is utilized as the key control variable, and the dosage control is accomplished as in the previously described embodiments.

DETAILED DESCRIPTION OF THE INVENTION

Figure 1:
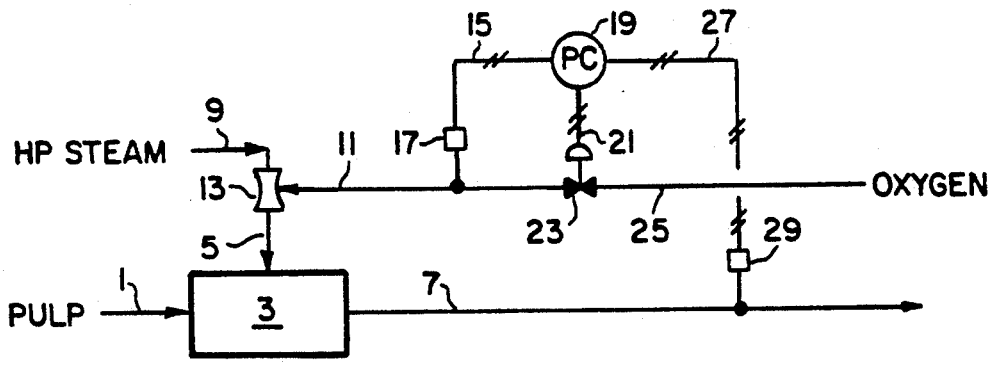
FIG. 1 is a schematic flow sheet for controlling oxygen dose according to the present invention utilizing an ejector for producing a steam-oxygen mixture.

In the delignification or bleaching of cellulosic pulp, the control of chemical dosage is important to ensure optimum product quality and economical chemical consumption. In order to apply a controlled dosage of one or more chemicals, the pulp flow rate must be known or estimated with reasonable accuracy before the rate of addition of the chemicals to the pulp can be determined and controlled. The present invention includes a number of embodiments for controlling chemical dosage in which the pulp flow rate is estimated from temperature measurements and appropriate thermal properties of the pulp. Accurate and direct measurement of the pulp flow rate, which is difficult to achieve, is not necessary. The method of the invention can be used for controlling the dosage of any chemical used in delignification and bleaching along with the addition of steam, including but not limited to oxygen, chlorine, chlorine dioxide, sodium hydroxide, sodium hypochlorite, sodium or hydrogen peroxide, and ozone.

The invention is particularly useful for controlling the dosage of oxygen in oxygen delignification and oxygen bleaching processes. The required dosage depends upon the concentration of lignin or other color-causing materials in the pulp, and also on the concentrations of other oxidizable compounds in the liquor associated with the pulp. The most widely used parameters in monitoring delignification and bleaching processes are the well-known Kappa number, which is a measure of the oxygen demand or residual chemically oxidizable compounds in the pulp, and brightness, a measure of light reflectance at specified wavelengths. The reduction in Kappa number in a delignification process, for example oxygen delignification, is generally proportional to dosage as long as oxidizable compounds remain in the pulp. Once these compounds have been oxidized, additional dosage of oxygen yields no additional Kappa number reduction and is essentially wasted. In actual practice, experience has shown that a small overdosage is desired to provide a kinetic driving force throughout the reactor and to compensate for normal variability in pulp properties. Once the desired dosage is determined for a given pulp (including a small overdosage), control of this dosage is important to ensure consistent product quality as well as economical use of chemicals. Because the flow rate of pulp varies in most delignification and bleaching processes, the flow rate of each treating chemical must be controlled to achieve the desired dosage. This can be accomplished by the present invention as described in the following disclosure.

The broadest and simplest embodiment of the invention is described with reference to FIG. 1. Pulp 1 is mixed in mixing zone 3 with steam-oxygen mixture 5 to form heated and oxygenated pulp 7. Pulp 1 can be any cellulosic pulp requiring treatment for the removal of lignin, color, or other contaminants, and can be a virgin pulp initially prepared from wood or a pulp comprising secondary fibers prepared from waste paper materials. Mixing zone 3 comprises any known mixing device such as an inline or static mixer, a mechanical mixing device such as IMPCO's Hi-Shear ® mixer or Kamyr's MC ® mixer, or a gas diffuser device such as that described in Australian Patent Application 22021/88. Steam-oxygen mixture 5 is prepared by passing high pressure steam 9, initially at about 100 to 800 psig, through ejector 13, thus forming a reduced pressure region which draws low pressure oxygen-containing gas 11 into the ejector. The steam and the oxygen-containing gas mix in the ejector and the resulting gas mixture 5 is discharged therefrom at a pressure between 20 and 200 psig. The operation of ejectors, also known as evactors, jet compressors, or thermocompressors, is well known in the art and information on these devices can be found for instance at p. 6-29 to 6-32 of the *Chemical Engineers' Handbook,* Fifth Edition, McGraw-Hill. When used as simple mixers, these devices are commonly referred to as eductors.

Low pressure oxygen-containing gas 11 is provided at a pressure between about 5 and 60 psia. Oxygen-containing gas 11 can be produced cryogenically by an onsite oxygen generator to yield a product with an oxygen concentration between about 95 and 99+ vol %, provided as vaporized liquid oxygen with an oxygen concentration between about 97 and 99+ vol %, or non-cryogenically produced utilizing membrane or pressure swing adsorption processes to yield a product containing between about 80 and 95 vol % oxygen. The resulting gas mixture 5 is thus at a pressure below that f high pressure steam 9 and above that of low-pressure oxygen-containing gas 11, and the steam-oxygen mixture 5 can be provided at the required pressure without the need to provide a high-pressure oxygen-containing gas. This feature allows the use of economical pressure swing or vacuum swing adsorption systems for the supply of oxygen without the need for additional compression.

In this embodiment, the flow rate of steam 9 is provided at a relatively constant flow rate by any type of known flow control system (not shown) in order to heat pulp 1 to a desired temperature in the range of about 160° to 220° F. The amount of oxygen-containing gas 11 drawn into ejector 13 is determined by the ejector internal dimensions, the flow rate and pressure of steam 9, the pressure and composition of oxygen-containing gas 11, and the ejector discharge pressure. The flow rate of stream 11 drawn into ejector 13 will depend solely on the supply pressure of stream 11 when the other parameters are constant, and the desired dosage of oxygen to pulp 1 thus can be achieved by controlling the pressure of stream 11. The required pressure of stream 11 is readily controlled by means of a feedback control system wherein the pressure is measured and converted into a signal 15 representative of the gas pressure by measurement/transmitter device 17. Signal 15 is used as the feedback control parameter to pressure controller 19, which determines the difference between signal 15 and a previously-determined set point, utilizes this difference together with a specific controller gain or proportional band to generate control signal 21, which controls the degree of opening of valve 23, which in turn controls the pressure of stream 11 at the required pressure. The controller gain or proportional band of controller 19 is determined based on the operating characteristics of ejector 13 and valve 23, the consistency, heat capacity, and temperature of pulp 1, the flow rate, pressure, and degree of superheat of steam 9, and the oxygen content of stream 11. If any of these parameters change, the controller gain or proportional band of controller 19 must be adjusted accordingly. As long as these parameters and the flow rate of pulp 1 are constant, the set point of controller 19 will control the oxygen dosage to pulp 1 at the desired level.

Alternately, a functional relationship between the pulp flow rate and the temperature of the pulp after mixing with a constant flow rate of steam can be established by (a) determining the heat capacity of the pulp prior to mixing with steam, (b) measuring the pressure and flow rate of the steam, (c) measuring the temperature of the pulp before and after mixing with steam, and (d) calculating by heat balance the pulp flow rate which corresponds to a unit temperature increase of the pulp. The pulp heat capacity is easily determined in the laboratory. This functional relationship can be used with the operating characteristics of valve 23 and ejector 13 to determine the controller gain or proportional band of controller 19.

In typical delignification and bleaching plants, the flow rate of pulp 1 varies for several reasons as earlier discussed. In order to control the desired oxygen dosage as pulp flow rate varies, the pressure of oxygen-containing steam 11 must be varied such that the required amount of oxygen is drawn into ejector 13 for a given pulp flow rate. This is accomplished by changing the set point of controller 19 in response to a change in the pulp flow rate in order to obtain a new pressure which will result in the proper amount of oxygen in gas mixture 5 to meet the desired oxygen dosage to pulp 1. The set point of controller 19 is changed as follows. The temperature of heated and oxygenated pulp 7 is determined and converted to representative signal 27 by temperature measurement/transmitter device 29. The temperature of pulp 7 and representative signal 27 will be proportional to the flow rate of pulp 1; if the pulp flow rate changes, signal 27 is used to reset the set point of controller 19 to reflect the change in pulp flow rate. For example, if the flow rate of pulp 7 increases, the temperature as determined by temperature measurement/transmitter device 29 will decrease, which will reset the set point of controller 19 to a higher pressure, which will cause valve 23 to open and thus increase the pressure of stream 11, which will result in a higher amount of oxygen-containing gas drawn into ejector 13, which in turn will maintain the dosage of oxygen to pulp 1 at the desired level.

The control of the pressure of stream 11 as described above by controller 19 operating on signals 15 and 27 is carried out continuously. Controller 19, signal 15, and signal 27 can be pneumatic or electronic as is known in the process control art. The controller gain or proportional band of controller 19 can be adjusted as required to account for changes in the consistency and temperature of pulp 1, the flow rate, pressure, and degree of superheat of steam 9, and the oxygen content of stream 11.

Figure 2:
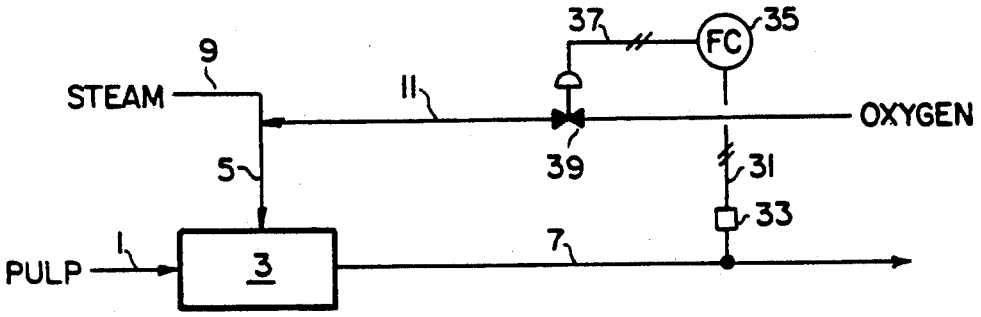
FIG. 2 is a schematic flowsheet for controlling oxygen dose according to the present invention utilizing direct flow control of oxygen prior to mixing with steam.

An alternate embodiment of the invention is presented in FIG. 2. In this embodiment, the required flow rate of oxygen-containing gas is controlled by a flow controller which operates on a control signal representative of the temperature of heated and oxygenated pulp 7. Steam 9 mixes with oxygen-containing stream 11 by direct piping or in an eductor, and the resulting mixture 5 is mixed with pulp 1 in mixer 3 as described above. Alternately, in this embodiment as well as additional embodiments illustrated by FIGS. 3, 5, and 6 below, steam 9 and oxygen 11 can be introduced directly into mixer 3 and mixed therein with pulp 1. The steam and oxygen-containing gas pressures need only be high enough to satisfy the process pressure requirements in the downstream pulp reactor system. The temperature of pulp 7 is measured and converted to representative signal 31 by temperature measurement/transmitter device 33. The flow rate of oxygen-containing gas 11 is controlled by flow controller 35 which determines the difference between signal 31 (which is proportional to the flow of pulp 7) and a predetermined set point, utilizes this difference with a specific controller gain or proportional band to generate control signal 37, which controls the degree of opening of valve 39, which in turn controls the flow rate of stream 11 to provide the required dosage of oxygen to pulp 1. In a manner similar to that described above, the controller gain or proportional band of controller 35 may be adjusted to account for changes in the operating characteristics of valve 39, the consistency and temperature of pulp 1, the flow rate, pressure, and degree of superheat of steam 9, and the oxygen content of stream 11. If any of these parameters change, the gain or proportional band of controller 35 must be adjusted accordingly. As long as these parameters and the flow rate of pulp 1 are constant, the set point of controller 35 will control the oxygen dosage to pulp 1 at the desired level.

Figure 3:
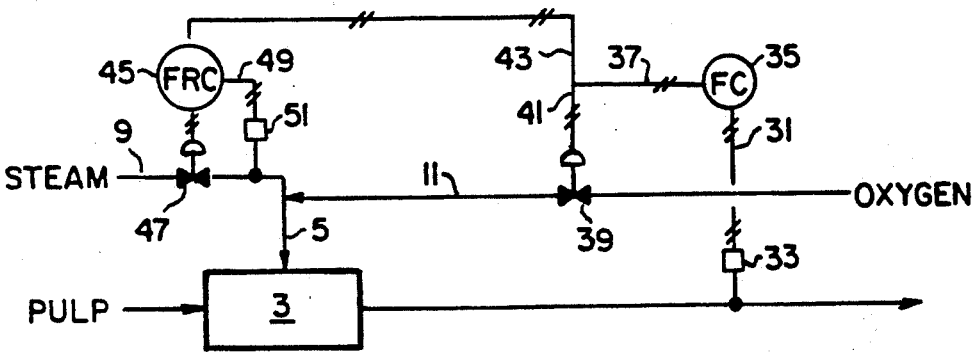
FIG. 3 is a schematic flowsheet for controlling oxygen dose and steam-oxygen ratio according to the present invention.

In an alternate embodiment of the invention as presented in FIG. 3, signal 37 from flow controller 35 is split into identical signals 41 and 43. Signal 41 controls the degree of opening of valve 39 as in the embodiment of FIG. 2; signal 43 is sent to flow ratio controller 45, the output of which controls the degree of opening of valve 47 which in turn controls the flow rate of steam 9 such that the ratio of stream to oxygen added to the pulp remains constant at a desired value. Flow ratio controller 45 also receives signal 49 generated by flow measurement/transmittal device 51; the ratio of signal 49 to signal 43 is compared to a fixed set point, and the difference between the measured ratio and the set point is the controller output to valve 47.

An optional embodiment derived from that of FIG. 3 can be utilized wherein the steam/oxygen flow ratio is controlled by measuring the flow rate of oxygen and converting this measurement into a control signal which is used as input to flow ratio controller 45, along with signal 49 which is representative of the flow rate of steam 9. Output from flow ratio controller 45 drives control valve 47, thereby controlling the steam-oxygen ratio in mixture 5 at the selected value. In this option, control valve 39 and flow controller 35 operate on steam-oxygen mixture 5 rather than oxygen stream 11, and signal 31 from temperature measurement/transmitter device 33 is the input to flow controller 35. The controller gain or proportional band of controller 35 is set based on the selected steam/oxygen ratio and other parameters noted above so that the rate of oxygen flow in steam-oxygen mixture 5 satisfies the desired oxygen dose on pulp.

The methods of the embodiments described above are satisfactory when the temperature of incoming pulp 1 is essentially constant. If the incoming pulp temperature varies, the methods of these three embodiments may be unsatisfactory for controlling oxygen dose, and the additional embodiments described below will be useful in such situations.

Figure 4:
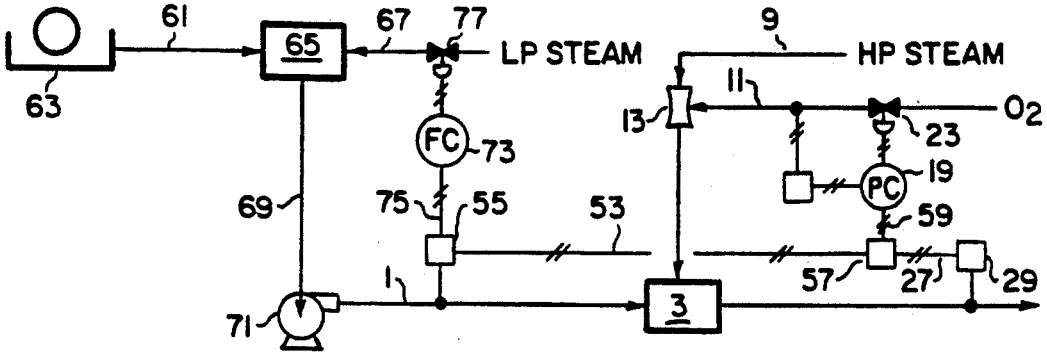
FIG. 4 is a schematic flowsheet for controlling oxygen dose according to the present invention utilizing an ejector for producing a steam-oxygen mixture when the pulp feed temperature is not constant.

FIG. 4 illustrates an alternate embodiment to that of FIG. 1, wherein the temperature increase of pulp 1 across mixer 3 is utilized as the control input to pressure controller 19. This is accomplished by generating signal 53 by means of temperature measurement/transmitter device 55, determining the difference between signal 53 and signal 27 in signal processor 57 to generate signal 59, which is the input to pressure controller 19. Signal 59 is representative of the flow rate of pulp 1 regardless of the temperatures before and after mixer 3, as long as the following parameters are constant: the operating characteristics of ejector 13 and valve 23, the consistency and temperature of pulp 1, the flow rate, pressure, and degree of superheat of high pressure steam 9, and the oxygen content of stream 11. If any of these parameters change, the controller gain or proportional band of controller 19 must be adjusted accordingly as earlier described. As long as these parameters and the flow rate pulp 1 are constant, the set point of controller 19 will control the oxygen dosage to pulp 1 at the desired level.

Alternately, a functional relationship between the pulp flow rate and the temperature of the pulp before and after mixing with a constant flow rate of steam can be established by (a) determining the heat capacity of the pulp prior to mixing with steam, (b) measuring the pressure and flow rate of the steam, (c) measuring the temperature of the pulp before and after mixing with steam, and (d) calculating by heat balance the pulp flow rate which corresponds to a unit temperature increase of the pulp. The pulp heat capacity is easily determined in the laboratory and is generally proportional to pulp consistency. This functional relationship can be used with the operating characteristics of valve 23 and ejector 13 to determine the controller gain or proportional band of controller 19.

It is an optional practice in pulp mills to heat the pulp in two stages as illustrated in FIG. 4. Pulp 61 from washer 63 is mixed in mixer 65 with low pressure steam 67 to yield preheated pulp 69 typically at a temperature between 140° and 180° F. Pulp 69 is pumped and pressurized by pulp slurry pump 71 to yield pulp 1. The flow rate of low pressure steam 67 can be controlled by flow controller 73 using input signal 75 (identical to signal 53) from temperature measurement/transmitter device 55. Steam 9 in this case is high pressure steam at between about 100 and 800 psig.

Figure 5:
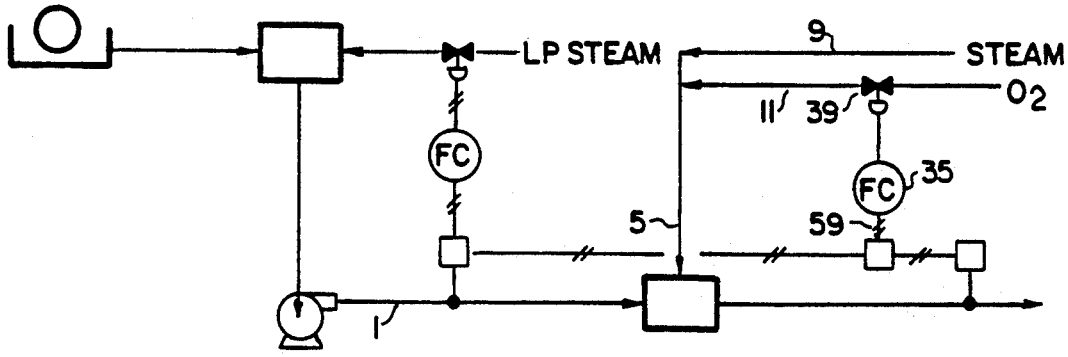
FIG. 5 is a schematic flowsheet for controlling oxygen dose according to the present invention utilizing direct flow control of oxygen prior to mixing with steam when the pulp feed temperature is not constant.

In an alternate embodiment shown in FIG. 5 (analogous to that illustrated in FIG. 2), the flow rate of oxygen-containing gas 11 is controlled by flow controller 35 which operates valve 39. Steam 9 (which is provided at an essentially constant flow rate) mixes with oxygen-containing stream 11 to form steam-oxygen mixture 5 which is utilized as earlier described. Flow controller 35 receives input signal 59 which is generated as described in the embodiment of FIG. 4.

Figure 6:
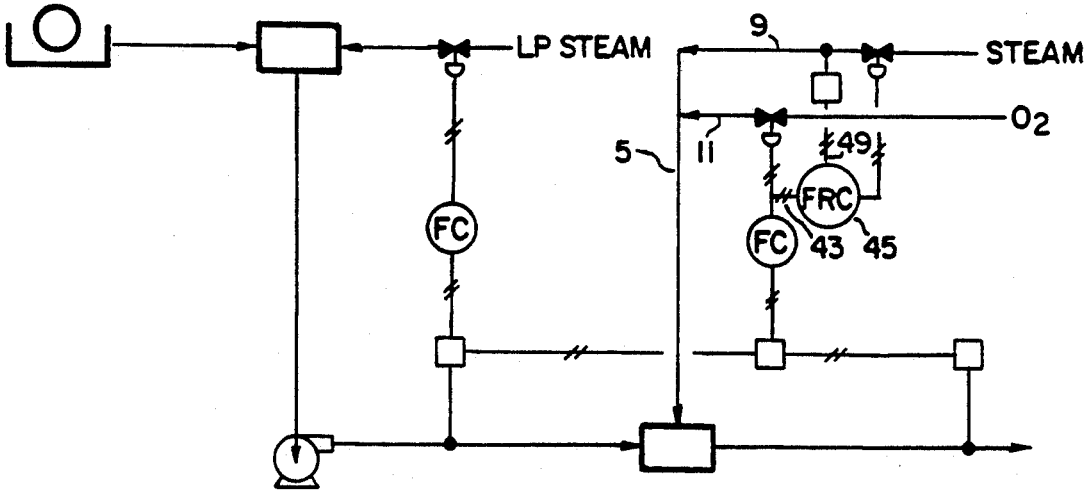
FIG. 6 is a schematic flowsheet for controlling oxygen dose and steam-oxygen ratio according to the present invention when the pulp feed temperature is not constant.

The steam-oxygen ratio may be controlled in an alternate embodiment illustrated in FIG. 6, which operates in a manner similar to the embodiments illustrated in FIGS. 3 and 5. Referring to FIG. 6, flow ratio controller 45 controls the flow rate of high pressure steam 9 such that the steam to oxygen ratio in steam-oxygen mixture 5 remains constant at a desired value. Flow ratio controller 45 receives input signal 43 which is proportional to the flow of oxygen-containing stream 11 and input signal 49 which is proportional to the flow rate of steam 9.

The embodiments of FIGS. 1 to 3 utilize a common feature which is an essential part of the present invention, namely, the use of the temperature of the pulp after steam addition as an indication of pulp flow rate. This eliminates the need to measure the pulp flow rate directly, which can be difficult and inaccurate, and allows improved control of oxygen dosage to the pulp. Similarly, the embodiments of FIGS. 4 to 6 utilize the temperature increase of the pulp associated with heating by steam addition, and are useful for cases in which the pulp feed temperature varies. Other embodiments for dosage control which use the features illustrated in FIGS. 1-6 are possible and fall within the bounds of the present invention, and include the control of dosage of other pulp treatment chemicals and including but not limited to chlorine, chlorine dioxide, sodium hydroxide, sodium hypochlorite, sodium or hydrogen peroxide, and ozone.

EXAMPLE

Oxygen delignification is performed on a pulp of 10% consistency at an average flow rate of 1000 tons per day (TPD) on an oven-dried basis. The pulp is preheated to about 170° F. in a steam mixer with low pressure steam (60 psig). Direct steam injection further heats the pulp from 170° F. to 210° F. The desired oxygen dosage is determined to be 2 wt % oxygen on pulp (oven-dried basis) and the delignification reactor residence time is 60 minutes; at this residence time, any higher dosage of oxygen will not react with the pulp and will be vented from the downstream blow tank. Due to variations in the pulp feed rate, pulp is supplied to the reactor at a rate which fluctuates between 950 and 1050 TPD. The required oxygen flow rate to achieve the desired dosage therefore varies between 1583 and 1750 lbs/hr with an average of 1667 lbs/hr. Steam is added to the pulp based on the average pulp flow rate and average oxygen flow rate such that the steam to oxygen mass ratio is 20. A steam-oxygen mixture is provided by passing saturated steam at 33,340 lbs/hr and 600 psig into an ejector (Croll-Reynolds Co., Inc. 2-stage Evactor Model 248). A stream of oxygen-containing gas (99.9 vol % purity), controlled at 5 psig by an electronic-actuated pressure control valve, is supplied to the suction of the ejector to yield the required 1667 lbs/hr of oxygen. The steam-oxygen mixture is sparged into the pulp through porous metal diffusers positioned in the pulp outlet line of a Kamyr MC® pump which increases the pulp temperature by 40° from 170° to 210° F. The temperature of the pulp before and after steam-oxygen addition is measured continuously and this differential temperature is converted to a representative electronic control signal. The pulp flow rate decreases to 950 TPD, and the measured pulp temperature increase therefore rises to 42° thereby changing the representative control signal. This signal is sent to the oxygen pressure controller, which reduces the oxygen supply pressure such that the amount of oxygen drawn into the ejector is reduced to 1583 lbs/hr to achieve the desired dosage of 2 wt % oxygen on pulp. Controlling the oxygen dose in this manner eliminates an oxygen overdose corresponding to 84 lb/hr of oxygen wastage which would occur at a pulp flow of 950 TPD without dosage control of the present invention. Likewise, when the pulp flow rate increases to 1050 TPD, the measured pulp temperature increase drops to 38°. The oxygen pressure controller responds to cause an increase in the rate of oxygen drawn into the ejector to 1750 lb/hr to achieve the required oxygen dosage of 2 wt % on pulp. Controlling the oxygen dosage in this manner eliminates an oxygen underdose of 83 lb/hr which would occur at a pulp flow of 1050 TPD without the control method of the present invention, which in turn would increase downstream chlorine requirements by about 190 lb/hr at this pulp flow rate. The temperature of the pulp fed to the reactor may be maintained at the desired level of 210° F. by adjusting the flow rate of low pressure steam used to preheat the pulp as shown in FIG. 4.

The method of the present invention thus allows the control of chemical dosage to pulp in delignification and bleaching processes without the need to measure directly the pulp flow rate. The method is especially useful for the control of oxygen dosage in oxygen delignification and bleaching processes, and is applicable to the use of high purity oxygen (95+ vol %) available at pressures of 5 to 60 psia as well as lower purity oxygen from pressure swing adsorption and membrane processes available at (80 to 95 vol %) and similar pressures. The method can be utilized for virgin pulp derived from wood or for secondary pulp derived from waste paper materials. The sue of an ejector to mix low pressure oxygen with high pressure steam is especially beneficial because the need for a separate oxygen compressor can be eliminated.

The control methods of the embodiments described above utilize individual or local pressure, flow, and flow ratio controllers as shown in FIGS. 1 through 6. The control methods of the present invention alternately can be applied utilizing a supervisory computer control system wherein the functions of these individual controllers and the computations required to determine pulp flow rates from pulp temperature measurements and heat balances are executed by the supervisory computer, which then directs the appropriate control signals to the local pressure, flow, and flow ratio control valves.

The essential characteristics of the present invention are described completely in the foregoing disclosure. One skilled in the art can understand the invention and make various modifications thereto without departing from the basic spirit thereof, and without departing from the scope and range of equivalents of the claims which follow.

We claim:

1. A method for controlling a desired chemical dosage to a continuous flow of cellulosic pulp heated by the addition of steam, said method comprising:

(a) initially establishing a functional relationship between the flow rate of said pulp and the temperature of said pulp by determining the heat capacity of said pulp, adding steam to said pulp, measuring the pressure and flow rate of said steam, measuring the temperature of said pulp before and after adding steam, and calculating by heat balance the pulp flow rate which corresponds to a unit temperature increase of said pulp, and thereafter repeating at a first interval the steps of:

(b) measuring the temperature of said pulp after said addition of steam and measuring the flow rate of said addition of steam;

(c) calculating the flow rate of said pulp by utilizing the relationship of step (a) and the temperature and steam flow rate of step (b);

(d) calculating the flow rate of said chemical to achieve a selected dosage and setting the desired flow rate of said chemical; and (e) continuously combining and mixing said pulp with said steam at the flow rate of step (b) and said chemical at the flow rate of step (d).

2. The method of claim 1 wherein step (a) is repeated at a second regular interval to account for variations in the consistency of said pulp, the steam pressure, and the steam flow rate.

3. The method of claim 2 which further comprises:

(1) passing said steam initially at a first pressure through an ejector as the motive gas, drawing a stream of oxygen-containing gas initially at a second and lower pressure into said ejector and discharging therefrom a gas mixture comprising steam and oxygen at a pressure intermediate said fist and second pressures, wherein said second pressure is regulated by a feedback pressure controller operating on said stream of oxygen-containing gas;

(2) mixing said gas mixture with said pulp;

(3) utilizing the temperature of said pulp after said addition of steam measured in step (b) to generate a signal proportional to the flow rate of said pulp mixture; and (4) utilizing said signal and said relationship of step (a) to adjust the set point of said pressure controller such that the amount of oxygen drawn into said eductor provides said desired dosage.

4. The method of claim 2 which further comprises:

(1) regulating the flow of an oxygen-containing gas by a flow controller having a set point determined by said relationship of step (a) such that said flow of oxygen-containing gas provides said desired dosage;

(2) mixing said oxygen-containing gas with steam and mixing the resulting gas mixture with said pulp;

(3) utilizing the temperature of step (b) to generate a first signal proportional to the flow rate of said pulp; and (4) utilizing said first signal as the input to said flow controller thereby regulating the flow rate of said oxygen-containing gas to provide said desired dosage.

5. The method of claim 4 which further comprises:

(5) measuring the flow rate of said steam and generating a second signal proportional to said flow rate; and (6) utilizing said first and second signals as control inputs to a flow ratio controller operating on said steam such that the flow ratio of oxygen to steam is maintained at a desired value.

6. The method of claim 1 wherein said chemical is selected from the group consisting of oxygen, chlorine, chlorine dioxide, sodium hydroxide, sodium hypochlorite, sodium or hydrogen peroxide, and ozone.

7. The method of claim 6 wherein said chemical is oxygen.

8. A method for controlling a desired chemical dosage to a cellulosic pulp flow heated by the addition of steam, said method comprising:

(a) initially establishing a functional relationship between the flow rate of said pulp and the temperature rise of said pulp by determining the heat capacity of said pulp, adding steam to said pulp, measuring the pressure and flow rate of said steam, measuring the temperature of said pulp before and after adding steam, and calculating by heat balance the pulp flow rate which corresponds to a unit temperature increase of said pulp, and thereafter repeating at a first interval the steps of:

(b) measuring the temperature of said pulp before and after said addition of steam and determining said temperature rise, and measuring the flow rate of said addition of steam;

(c) calculating the flow rate of said pulp by utilizing the relationship of step (a) and the temperature and steam flow rate of step (b);

(d) calculating the flow rate of said chemical to achieve a selected dosage and setting the flow rate of said chemical to the desired flow rate; and (e) continuously combining and mixing said pulp with said steam at the flow rate of step (b) and said chemical at the flow rate of step (d).

9. The method of claim 8 wherein step (a) is repeated at a second regular interval to account for variations in the consistency of said pulp, the steam pressure, and the steam flow rate.

10. The method of claim 9 which further comprises:

(1) passing said steam initially at a first pressure through an ejector as the motive gas, drawing a stream of oxygen-containing gas initially at a second and lower pressure into said ejector and discharging therefrom a gas mixture comprising steam and oxygen at a pressure intermediate said fist and second pressures, wherein said second pressure is regulated by a feedback pressure controller operating on said stream of oxygen-containing gas;

(2) mixing said gas mixture with said pulp;

(3) utilizing the temperature rise of said pulp caused by said addition of steam measured in step (b) to generate a signal proportional to the flow rate of said pulp mixture; and (4) utilizing said signal and said relationship of step (a) to adjust the set point of said pressure controller such that the amount of oxygen drawn into said eductor provides said desired dosage.

11. The method of claim 9 which further comprises:

(1) regulating the flow of an oxygen-containing gas by a flow controller having a set point determined by said relationship of step (a) such that said flow of oxygen-containing gas provides said desired dosage;

(2) mixing said oxygen-containing gas with steam and mixing the resulting gas mixture with said pulp;

(3) utilizing the temperature rise of said pulp caused by said addition of steam measured in step (b) to generate a first signal proportional to the flow rate of said pulp mixture; and (4) utilizing said first signal as the control input to said flow controller thereby regulating the flow rate of said oxygen-containing gas.

12. The method of claim 11 which further comprises:

(5) measuring the flow rate of said steam and generating a second signal proportional to said flow rate; and (6) utilizing said first and second signals as control inputs to a flow ratio controller operating on said steam such that the flow ratio of oxygen to steam is maintained at a desired value.

13. The method of claim 8 wherein said chemical is selected from the group consisting of oxygen, chlorine, chlorine dioxide, sodium hydroxide, sodium hypochlorite, sodium or hydrogen peroxide, and ozone.

14. The method of claim 13 wherein said chemical is oxygen.

15. A method for controlling dosages of oxygen and steam to a continuous stream of cellulosic pulp, said method comprising:

(a) providing a gas mixture comprising oxygen and steam at a selected molar ratio of steam to oxygen;

(b) initially establishing a functional relationship between the flow rate of said pulp and the temperature of said pulp by determining the heat capacity of said pulp, mixing said pulp with said gas mixture, measuring the pressure and flow rate of said gas mixture, measuring the temperature of said pulp before and after mixing with said gas mixture, and calculating by heat balance the pulp flow rate which corresponds to a unit temperature increase of said pulp, and thereafter repeating at a first interval the steps of:

(c) measuring the temperature of said pulp following mixing with said gas mixture and measuring the flow rate of said gas mixture;

(d) determining the flow rate of said pulp by utilizing said temperature and flow rate measured in step (c) and the functional relationship of step (b);

(e) calculating the flow rate of said gas mixture to achieve selected dosages of oxygen and steam, and setting the desired flow rate of said mixture; and (f) continuously combining and mixing said pulp with said gas mixture at the flow rate of step (e).

16. The method of claim 15 wherein step (b) is repeated at a second regular interval to account for variations in the consistency of said pulp and the pressure of said mixture.

* * * * *